US010473421B1

(12) United States Patent
Civile

(10) Patent No.: US 10,473,421 B1
(45) Date of Patent: Nov. 12, 2019

(54) WATER GUN REFILL STATION

(71) Applicant: SMARTPOOL LLC, Lakewood, NJ (US)

(72) Inventor: Justin Civile, Lakewood, NJ (US)

(73) Assignee: SMARTPOOL LLC, Lakewood, NJ (US)

( * ) Notice: Subject to any disclaimer, the term of this patent is extended or adjusted under 35 U.S.C. 154(b) by 0 days.

(21) Appl. No.: 16/050,837

(22) Filed: Jul. 31, 2018

(51) Int. Cl.

| | |
|---|---|
| ***A63H 3/18*** | (2006.01) |
| ***A63H 33/30*** | (2006.01) |
| ***F41B 9/00*** | (2006.01) |
| ***A63G 31/00*** | (2006.01) |
| *A63H 27/10* | (2006.01) |

(52) U.S. Cl.
CPC ..... *F41B 9/0071* (2013.01); *A63G 31/007* (2013.01); *A63H 2027/1083* (2013.01); *F41B 9/0018* (2013.01)

(58) Field of Classification Search
CPC .... F41B 9/0071; F41B 9/0018; A63G 31/007; A63H 2027/1083
USPC ..... 446/473
See application file for complete search history.

(56) References Cited

U.S. PATENT DOCUMENTS

| | | | | |
|---|---|---|---|---|
| 5,322,191 | A * | 6/1994 | Johnson | B05B 9/0426 222/175 |
| 5,586,688 | A * | 12/1996 | Johnson | F41B 9/0021 200/82 R |
| 5,915,771 | A * | 6/1999 | Amron | F41B 9/0053 222/401 |
| 6,929,151 | B1 * | 8/2005 | Clayton | F41B 9/0009 141/346 |
| 7,097,073 | B2 * | 8/2006 | Zimmerman | F41B 9/0012 222/255 |
| 7,458,485 | B2 * | 12/2008 | Amron | F41B 9/0018 222/79 |
| 8,316,897 | B2 * | 11/2012 | Lucas | F41A 17/46 141/113 |
| 8,469,234 | B1 * | 6/2013 | Loomis | F41B 9/0025 222/386.5 |

* cited by examiner

*Primary Examiner* — Nini F Legesse
(74) *Attorney, Agent, or Firm* — Birch, Stewart, Kolasch & Birch, LLP

(57) ABSTRACT

A water gun refilling station for refilling a water gun includes a base positioned a predetermined distance above a ground surface. A fitting is attached to the base and is in fluid communication with a source of pressurized water. The fitting is selectively operated to be opened and closed. The water gun includes a water storage container. An attachment is connected to the water gun and is in fluid communication with the water storage container. The attachment may be selectively manually connected to the fitting. An air vent is operatively connected to the water storage container. Wherein when the attachment is manually connected to the fitting, the air vent is opened within the water storage container to enable a supply of pressurized water to quickly refill the water gun.

20 Claims, 7 Drawing Sheets

WATER GUN REFILL STATION

BACKGROUND OF THE INVENTION

Field of the Invention

The present invention is directed to a water refilling station to enable a water gun to be quickly refilled.

Description of Background Art

Squirt guns are known wherein the squirt gun is filled with water and the water is discharged from the squirt gun by pulling on the trigger of the gun to pump the water from the squirt gun in a steady stream. This type of single shot squirt gun does not include a pressured water reservoir and does not include a trigger pump. Thus, the conventional squirt gun is limited in range and duration of the water jet.

Pressurized water guns are available that include a water reservoir that is pressurized by a manually actuated pump to supply pressure to the water reservoir. An individual can release water from the water reservoir by holding a trigger to eject a steady long stream of water as long as the water reservoir is pressurized.

Further, water guns are available that are connected by a conduit to a continuous source of pressurized water. However, this type of gun is not portable. Thus, a user must remain in a certain location that is dictated by the length of the conduit for the pressurized water since the water gun is directly supplied with water from the conduit.

It is common for a group of individuals to use water guns in a contest to try to spray each other with water. When a water gun is empty, it is necessary to refill the water gun by using a faucet, a hose or a bin full of water that directs water into a water tank in the water gun. However, the use of a faucet, hose or bin full of water is time consuming and not very efficient when the group of individuals are spraying each other with water. The refilling requires play action to be stopped and creates undesirable challenges such as water spilling, water filling the gun where it should not be filled and it is in general time consuming.

Normally, when an individual exhausts the supply of water within his/her water gun this individual is then drenched with water by others in the group. Thus, it is necessary to provide a water gun refilling station that can quickly refill a water gun.

It is a problem with conventional water guns to refill a water gun from a conventional faucet, hose or bin full of water.

SUMMARY AND OBJECTS OF THE INVENTION

An object of the present invention is to provide a water gun refill station on a stand with a female release valve mounted to a top plate. Water will be fed to the release valve by a standard garden hose from the underside of the refilling station.

The water gun will have a male adaptor on the bottom of the water gun that will fit into the female release valve on the stand. The male adaptor will be connected to the water storage container through either a direct connection or a conduit. The water will pass from the valve of the refill station into the male adaptor and ultimately refill the water gun storage container.

In another embodiment, it is an object of the present invention to provide a water gun refill station on a stand with a male release valve mounted to a top plate. Water will be fed to the release valve by a standard garden hose from the underside of the refilling station.

The water gun will have a female adaptor on the bottom of the gun that will fit into the male release valve on the stand. The female adaptor will be connected to the water storage container through either a direct connection or a conduit. The water will pass from the valve of the refill station into the female adaptor and ultimately refill the water gun storage container.

The size and function of the water gun refill station leads itself to a mature, preteen child. This is due to the hand-eye coordination, height and strength required to successfully use the product. The age requirement also takes into account the actual game play that takes place when using this product.

A single pump action water gun that does not rely on built up pressure is used with the water gun refill station. There must be adequate space inside the handle or in the water tank to accommodate the male/female adaptor and hose. The underside of the storage container must have clearance to allow for the hose/conduit to connect to the male/female adaptor. The hose/conduit from the male/female adaptor must reach the top of the storage container and be fixed with a pressure release valve to prevent water leakage. The pressure release valve should be made of soft plastic or rubber that will help reduce draining back through the conduit but allow water to pass through the pressure release valve if the water storage container is overfilled.

The cap of the water gun should be a screw off cap or be able to accept a screw or other fasteners so that modifications can be made. A tamper proof cap should be used to permit ready access to the storage container during use. The cap should allow air to escape through the cap during refilling but then seal the storage container after refilling so that water does not easily leak from the top. The pressure release valve should be made from a rubber material. The vent cap may be made from a plastic material. The reason for the screw cap or cap that is attached by screws or other fasteners is to easily modify an existing cap and to allow the cap to be replaced if broken by the user.

These and other objects of the present invention are achieved by providing a water gun refilling station for refilling a water gun that includes a base positioned a predetermined distance above a ground surface. A fitting is attached to the base and is in fluid communication with a source of pressurized water. The fitting is selectively operated to be opened and closed. The water gun includes a water storage container for storing a predetermined quantity of water. An attachment is connected to the water gun and is in fluid communication with the water storage container. The attachment may be selectively, manually connected to the fitting. An air vent is operatively connected to the water storage container. Wherein when the attachment is manually connected to the fitting, the air vent is opened within the water storage container to enable a supply of pressurized water to quickly refill the water gun.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
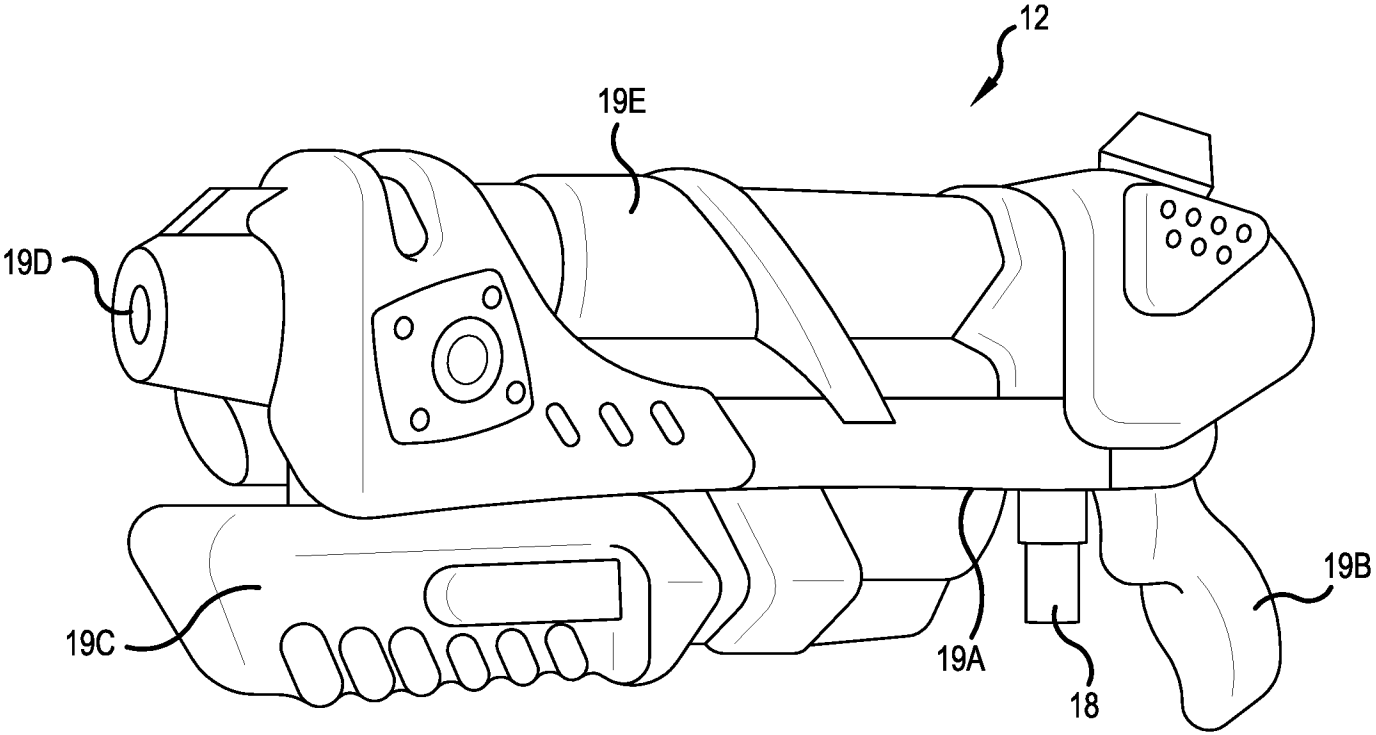
FIG. 1 is a perspective view of a water gun for use with a water gun refilling station according to an embodiment of the present invention.
Figure 2:
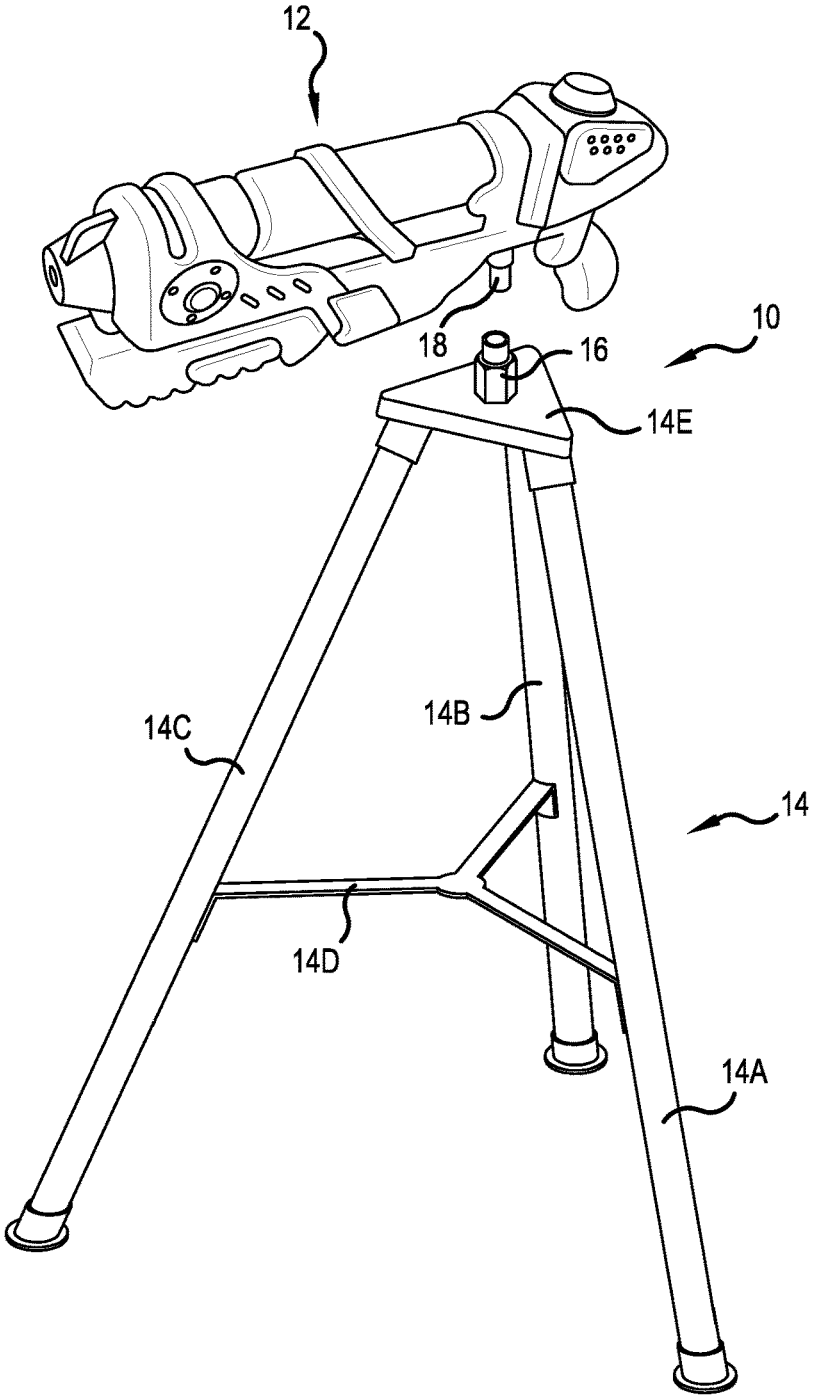
FIG. 2 is a perspective view illustrating the water gun adapted to be used with a refilling station positioned a predetermined distance above a ground surface with a fitting attached to the water gun refilling station that is in fluid communication with a source of pressurized water according to an embodiment of the present invention.

As illustrated in FIGS. 1 and 2, a water gun refilling station 10 is provided for refilling a water gun 12. A tripod base 14 includes legs 14A, 14B and 14C that are connected to each other by a support member 14D. The tripod base 14 is positioned a predetermined distance above a ground surface to enable individuals to easily use the tripod base 14 to refill the water gun 12. The water gun 12 is a single pump action water gun that does not rely on a buildup of pressure within the water gun 12 to actuate the water gun 12. An individual would actuate the single pump 19C to discharge a flow of water through the opening 19D. A housing 19E provides adequate space for positioning a water storage container and a supply conduit for supplying pressurized water through an attachment 18 from a fitting 16.

The tripod base 14 includes a top 14E for mounting the fitting 16 that is attached to the tripod base 14. The fitting 16 is in fluid communication with a source of pressurized water, such as a garden hose 79 connected to one end of the fitting 16.

As illustrated in FIGS. 7-10, the water gun 12 includes a water storage container 22 for storing a predetermined quantity of water with a supply conduit 30 for receiving water through the attachment 18 after the attachment 18 is manually connected to the fitting 16. As illustrated in FIG. 1, the attachment 18 is connected to a bottom 19 of the water gun 12 and is in fluid communication, through a supply conduit 30, with the water storage container 22. The attachment 18 may be manually connected to the fitting 16. An air vent 40 is mounted on an opening 42 in the water storage container 22 to enable a supply of pressurized water to quickly refill the water gun 12.

Figure 5:
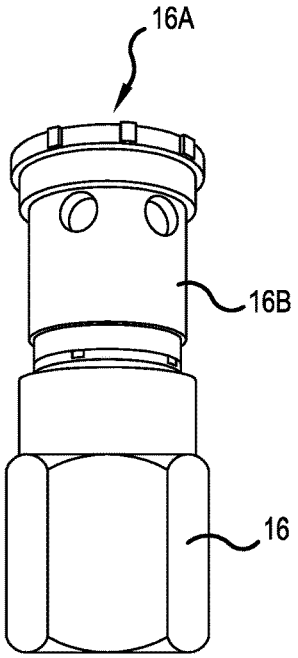
FIG. 5 is an enlarged view of the compression coupler that may be used as the fitting according to an embodiment of the present invention.
Figure 6:
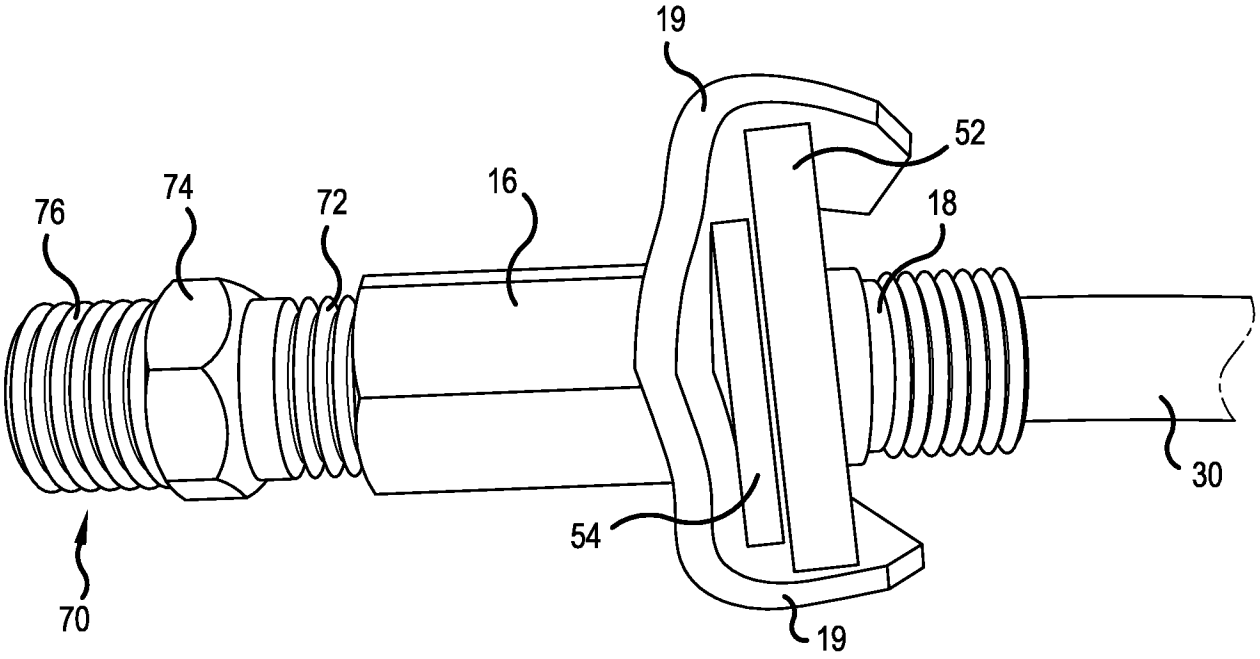
FIG. 6 is an enlarged cut away view illustrating the fitting connected to the attachment formed inside the water gun according to an embodiment of the present invention.

As illustrated in FIGS. 5 and 6, the fitting 16 can be a female compression coupler that is selectively operated to be opened and closed by manually connecting to the attachment 18. The attachment 18 may be a male coupler for supplying pressurized water to the water storage container 22. The female compression coupler would include an opening 16A adapted to receive the male coupler of the attachment 18. In FIG. 6, in operation, the inner portion 16B of the fitting 16 would be moved downwardly into the fitting 16 to provide communication with the source of pressurized water to flow through the fitting 16 and into the water storage container 22 through the supply conduit 30. After disengagement of the fitting 16 from the attachment 18, the fitting 16 is closed to stop the supply of pressurized water to the water gun 12 and the attachment 18 is closed to prevent leakage of water from the water gun 12.

In another embodiment, the fitting 16 can be a male compression coupler that is selectively operated to be opened and closed by manually connecting to the attachment member 18. The attachment member 18 may be a female coupler for supplying pressurized water to the water storage container. After disengagement of the fitting 16 from the attachment 18, the fitting 16 is closed to stop the supply of pressurized water to the water gun 12 and the attachment 18 is closed to prevent leakage of water from the water gun 12.

Figure 4:
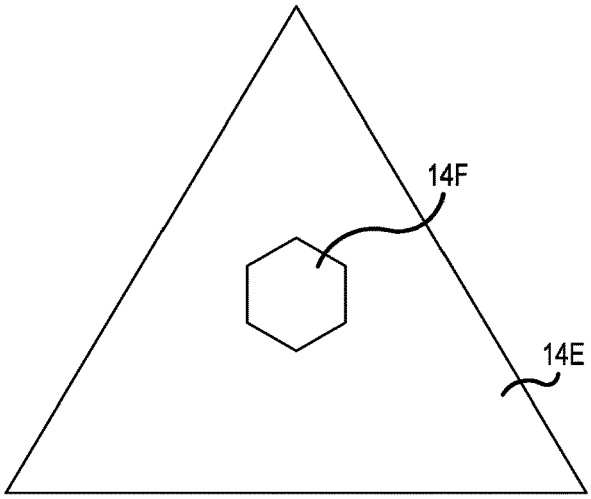
FIG. 4 is a top elevational view of a hexagonal shape of the fitting for locking the fitting relative to the water gun refilling station according to an embodiment of the present invention.

As illustrated in FIG. 4, the top 14E of the base member 14 may include an opening that is an irregular shape that conforms to an irregular shape of the fitting 16. In this way, the fitting 16 is prevented from rotating relative to the top 14E of the base 14. The connector 70 may also be attached to the fitting 16. In this case, the fitting 74 would be positioned within the hexagon 14F. In an embodiment of the present invention, the irregular shape of the opening in the top 14E may be a hexagon 14F.

Figure 3:
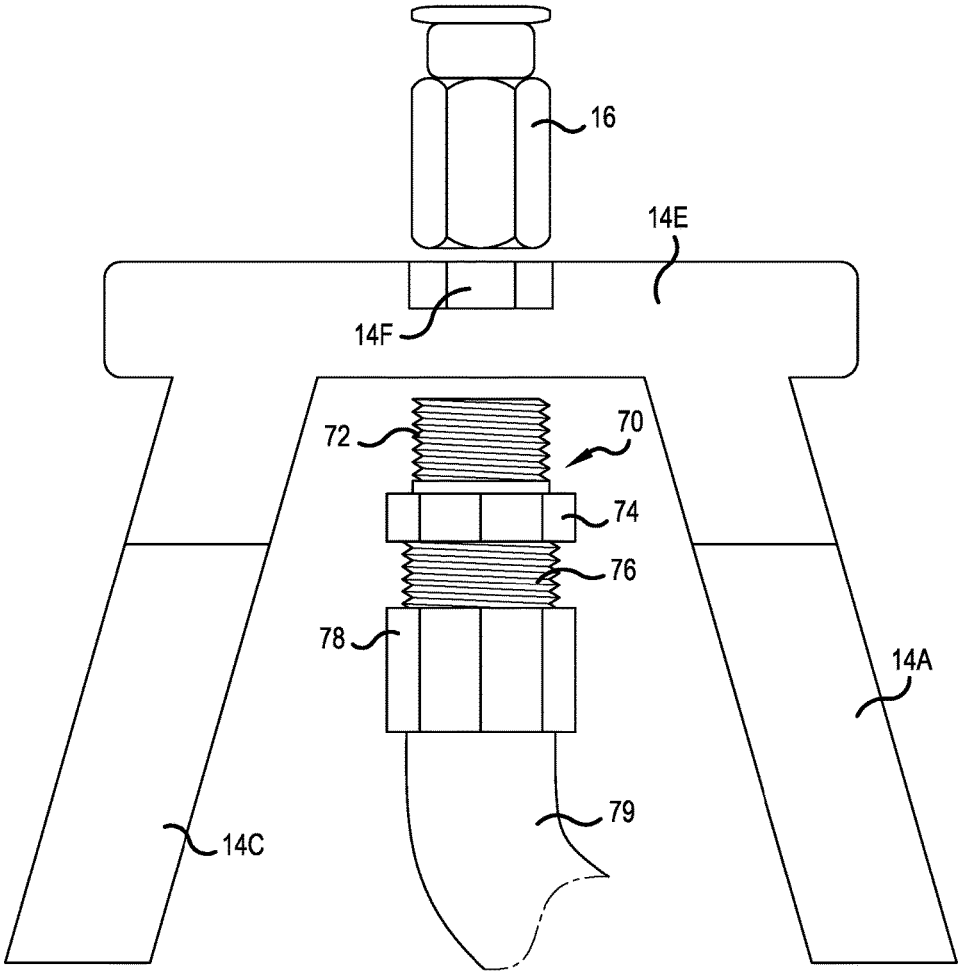
FIG. 3 is an exploded elevational view illustrating the fitting attached to the water gun refilling station with a connector designed to be connected to a source of pressurized water according to an embodiment of the present invention.

As illustrated in FIG. 3, the fitting 16 is mounted within the irregular shaped opening, that may be a hexagon 14F, in the top 14E of the base member 14. A connector 70 includes an upper threaded section 72 to enable the connector 70 to be screwed into the fitting 16 to secure the fitting 16 relative to the base member 14. The connector 70 includes a lower threaded section 76 to enable a hose connector 78 attached to the garden hose 79 to be secured to the lower threaded section 76 of the connector 70.

As illustrated in FIG. 6, the fitting 16 is manually connected to the attachment 18 that projects from a bottom portion 19 of the water gun 12. An insert 52 is positioned adjacent to the bottom portion 19 to reinforce this section of the water gun 12. A rubber washer 54 is positioned adjacent to an insert 52 to seal the interior of the water gun 12 from pressurized water that may spray up during refilling of the water gun 12.

Figure 7:
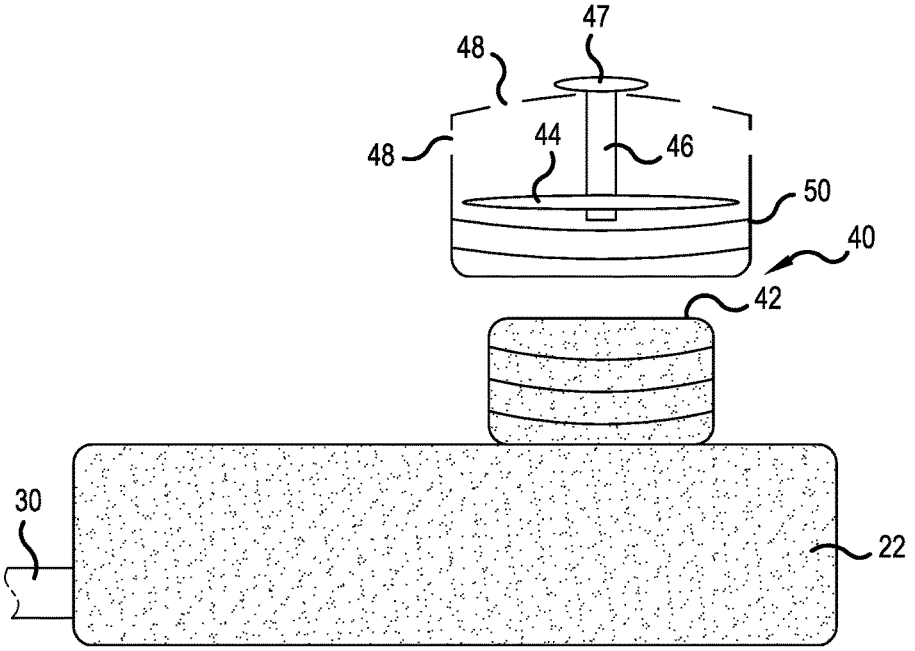
FIG. 7 illustrates a ventilation cap that may be threaded or secured by screws or other fasteners unto the water storage container according to an embodiment of the present invention.

As illustrated in FIG. 7, the air vent 40 is a one-way valve 44 positioned on a shaft 46 vertically movable within the cap 50 for enabling air and water to be discharged from the water storage container 22 during refilling and for sealing the water storage container 22 during use. The shaft 46 includes an enlarged portion 47 for retaining the one-way valve 44 relative to the cap 50 to ensure vertical movement of the one-way valve 44 relative to the cap 50.

Figure 8:
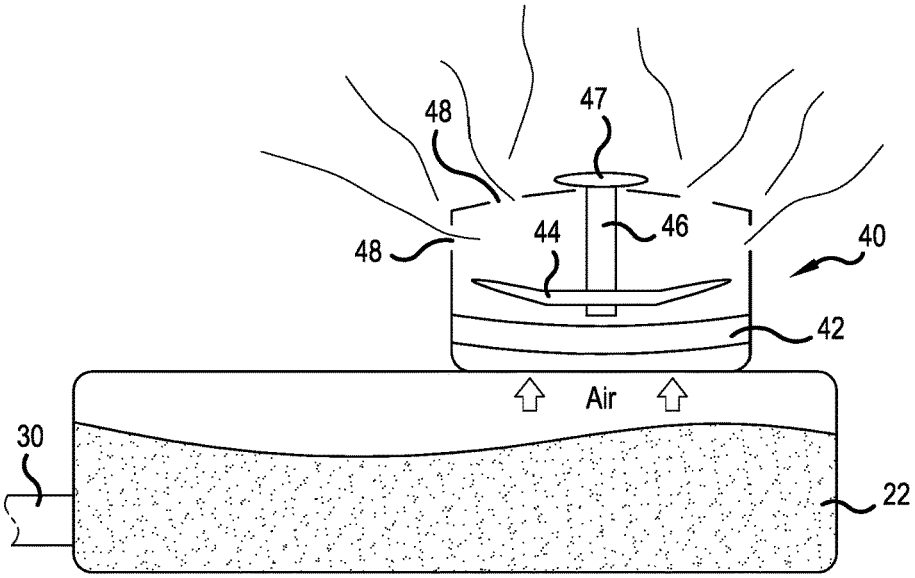
FIG. 8 illustrates the ventilation cap mounted unto the water storage container wherein a pressure relief valve disposed within the ventilation cap is moved to the open position to permit air to be exhausted to the atmosphere during refilling according to an embodiment of the present invention.

As illustrated in FIG. 8, the cap 50 is screwed, or secured by screws or other fasteners, onto the opening 42 in the water storage container 22. The one-way valve 44 is mounted within the cap 50 for enabling air to be discharged from the water storage container 22 during initial refilling of the water storage container 22. As illustrated in FIGS. 7 and 8, the cap 50 includes a plurality of openings 48 for enabling air and water to discharge from the water storage container 22 during refilling of the water storage container 22 during use.

Figure 9:
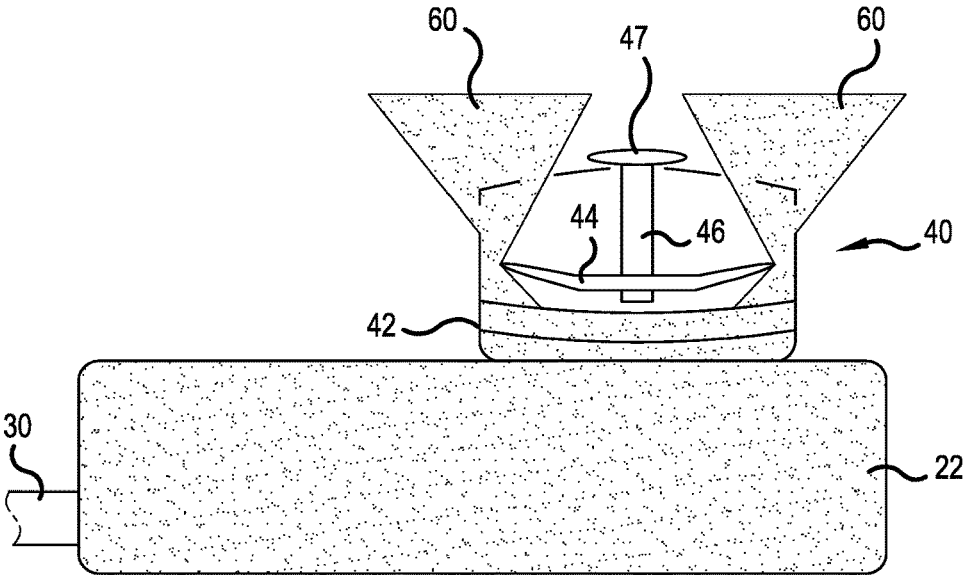
FIG. 9 illustrates the ventilation cap mounted unto the water storage container with the pressure relief valve, disposed within the ventilation cap, being in the open position to permit excess water to exit from the water storage container according to an embodiment of the present invention.

As illustrated in FIG. 9, the one-way valve 44 is mounted within the cap 50 for enabling excess water 60 to be discharged from the water storage container 22 during initial refilling of the water storage container 22 when too much water is supplied through the fitting 16 and the attachment 18.

Figure 10:
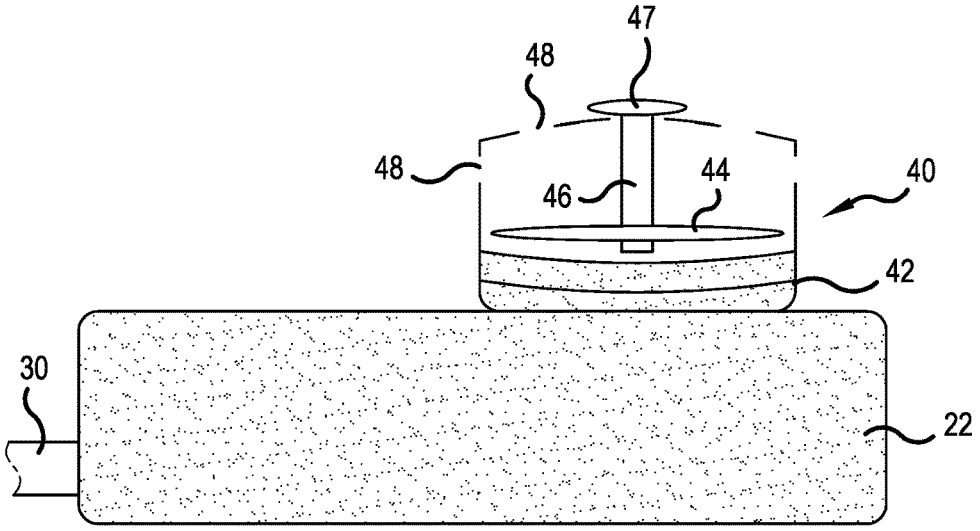
FIG. 10 illustrates the ventilation cap mounted unto the water storage container with the pressure relief valve, disposed within the ventilation cap, being in a closed position to prevent water from exiting from the water storage container after the water gun is removed from the water refilling station according to an embodiment of the present invention.

As illustrated in FIG. 10, the one-way valve 44 is mounted within the cap 50 for preventing water from being discharged from the water storage container 22 during use of the water gun 12.

The attachment 18 is connected to a bottom section 19A of the water gun 12 adjacent to the handle 19B. The attachment 19 of the water gun 12 is manually connected to the fitting 18 by pressing down on the water gun 12 to connect the attachment 18 to the fitting 16 for enabling water to quickly refill the water storage container 22 while air is discharged through the one-way valve 44 in the water storage container 22 during refilling and wherein excess water can be discharged from the water storage container 22 when the pressurized water exceeds the limits of the water storage container 22. The one-way valve 44 seals the water storage container 22 when full.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water gun refilling station comprising:

a base adapted to be positioned a predetermined distance above a ground surface;

a fitting attached to the base and being in fluid communication with a source of pressurized water, said fitting being selectively operated to be opened and closed;

a single pump action, single shot water gun, said single pump action, single shot water gun includes a water storage container, said water storage container being a fixed size that is not expandable for holding a predetermined volume of water;

a quick release attachment connected to the single pump action, single shot water gun and adapted to be operatively connected to said fitting for selectively opening said fitting to provide a direct fluid communication between the source of pressurized water and the water storage container when the quick release attachment of the single pump action, single shot water gun is briefly positioned on said fitting for a predetermined period of time and thereafter released from the fitting for use of the single pump action, single shot water gun independently of the base; and an air vent operatively connected to the water storage container, wherein when said quick release attachment is manually connected to the fitting, the air vent is opened within the water storage container to enable a direct supply of pressurized water to directly, quickly refill the water storage container of the single pump action, single shot water gun by enabling air within the water storage container to be vented by said air vent during refilling to prevent pressure buildup in the water storage container and thereafter the quick release attachment of the single pump action, single shot water gun is removed from the fitting to enable operation of the single pump action, single shot water gun independently of the base.

2. The water gun refilling station according to claim 1, wherein the base is a tripod for supporting the fitting the predetermined distance above the ground surface.

3. The water gun refilling station according to claim 1, wherein the fitting is a female compression coupler that is connected to the source of pressurized water at one end thereof and is manually actuated when a male quick release attachment is connected to the compression coupler for supplying pressurized water to the water storage container.

4. The water gun refilling station according to claim 1, wherein the fitting is a male compression coupler that is connected to the source of pressurized water at one end thereof and is manually actuated when a female quick release attachment is connected to the compression coupler for supplying pressurized water to the water storage container.

5. The water gun refilling station according to claim 1, wherein the fitting includes an irregular shape that conforms to an irregularly shaped form in a top portion of the base for preventing rotation of the fitting relative to the base.

6. The water gun refilling station according to claim 5, wherein the irregular shape is a hexagon.

7. The water gun refilling station according to claim 1, wherein the air vent is a one-way valve for enabling air and water to discharge from the water storage container during refilling and seals the water storage container during use.

8. The water gun refilling station according to claim 7, wherein said water storage container includes a threaded opening, or an opening that accepts screws or other fasteners, with a cap mounted thereon, said one-way valve being mounted within said cap for enabling air and water to discharge from the water storage container during refilling and seals the water storage container during use.

9. The water gun refilling station according to claim 8, wherein said cap includes a plurality of openings to enable air and water to discharge from the water storage container during refilling of the water storage container during use.

10. The water gun refilling station according to claim 1, wherein said quick release attachment is manually connected to the fitting by pressing down on the water gun to connect the quick release attachment to the fitting for enabling water to quickly refill the water storage container while air is discharged through said air vent being a one-way valve in the water storage container during refilling and thereafter the one-way valve seals the water storage container when full.

11. A water gun refilling station comprising:

a fitting in fluid communication with a source of pressurized water, said fitting being selectively operated to be opened and closed;

a single pump action, single shot water gun, said single pump action, single shot water gun includes a water storage container, said water storage container being a fixed size that is not expandable for holding a predetermined volume of water;

a quick release attachment connected to the single pump action, single shot water gun and adapted to be operatively connected to said fitting for selectively opening said fitting to prove a direct fluid communication between the source of pressurized water and the water storage container when the quick release attachment of the single pump action, single shot water gun is briefly positioned on said fitting for a predetermined period of time and thereafter released from the fitting for use of the single pump action, single shot water gun independently of the base; and an air vent operatively connected to the water storage container, wherein when said quick release attachment is manually connected to the fitting, the air vent is opened within the water storage container to enable a direct supply of pressurized water to directly, quickly refill the water storage container of the single pump action, single shot water gun by enabling air within the water storage container to be vented by said air vent during refilling to prevent pressure buildup in the water storage container and thereafter the quick release attachment of the single pump action, single shot water gun is removed from the fitting to enable operation of the single pump action, single shot water gun independently of the base.

12. The water gun refilling station according to claim 11, and further including a tripod base for supporting the fitting a predetermined distance above a ground surface.

13. The water gun refilling station according to claim 12, wherein the fitting includes an irregular shape that conforms to an irregularly shaped form in a top portion of the tripod base for preventing rotation of the fitting relative to the base.

14. The water gun refilling station according to claim 13, wherein the irregular shape is a hexagon.

15. The water gun refilling station according to claim 11, wherein the fitting is a female compression coupler that is connected to the source of pressurized water at one end thereof and is manually actuated when a male quick release attachment is connected to the compression coupler for supplying pressurized water to the water storage container.

16. The water gun refilling station according to claim 11, wherein the fitting is a male compression coupler that is connected to the source of pressurized water at one end thereof and is manually actuated when a female quick release attachment is connected to the compression coupler for supplying pressurized water to the water storage container.

17. The water gun refilling station according to claim 11, wherein the air vent is a one-way valve for enabling air and water to discharge from the water storage container during refilling and seals the water storage container during use.

18. The water gun refilling station according to claim 17, wherein said water storage container includes a threaded opening, or on opening that accepts screws or other fasteners, with a cap mounted thereon, said one-way valve being mounted within said cap for enabling air and water to discharge from the water storage container during refilling and seals the water storage container during use.

19. The water gun refilling station according to claim 18, wherein said cap includes a plurality of opening to enable air and water to discharge from the water storage container during refilling of the water storage container during use.

20. The water gun refilling station according to claim 11, wherein said attachment is manually connected to the fitting by pressing down on the water gun to connect the attachment to the fitting for enabling water to directly, quickly refill the water storage container while air is discharged through said air vent being a one-way valve in the water storage container during refilling and thereafter the one-way valve seals the water storage container when full.

* * * * *